US011316257B2

(12) United States Patent
Lv et al.

(10) Patent No.: US 11,316,257 B2
(45) Date of Patent: Apr. 26, 2022

(54) ANTENNA, ANTENNA ASSEMBLY, AND BASE STATION

(71) Applicant: HUAWEI TECHNOLOGIES CO., LTD., Guangdong (CN)

(72) Inventors: Jinsong Lv, Shanghai (CN); Tao Pu, Shanghai (CN); Weihong Xiao, Xi'an (CN); Honggang Xu, Shanghai (CN); Runxiao Zhang, Dongguan (CN)

(73) Assignee: HUAWEI TECHNOLOGIES CO., LTD., Guangdong (CN)

( * ) Notice: Subject to any disclaimer, the term of this patent is extended or adjusted under 35 U.S.C. 154(b) by 0 days.

(21) Appl. No.: 16/861,425

(22) Filed: Apr. 29, 2020

(65) Prior Publication Data

US 2020/0259248 A1 Aug. 13, 2020

Related U.S. Application Data

(63) Continuation of application No. PCT/CN2017/108366, filed on Oct. 30, 2017.

(51) Int. Cl.

| | |
|---|---|
| ***H01Q 1/24*** | (2006.01) |
| ***H01Q 1/12*** | (2006.01) |
| ***H01Q 1/42*** | (2006.01) |
| ***H01Q 21/00*** | (2006.01) |
| ***H01Q 21/28*** | (2006.01) |
| ***H01Q 21/06*** | (2006.01) |

(Continued)

(52) U.S. Cl.

CPC ..... *H01Q 1/246* (2013.01); *H01Q 1/1228* (2013.01); *H01Q 1/1264* (2013.01); *H01Q 1/428* (2013.01);

(Continued)

(58) Field of Classification Search

CPC .. H01Q 1/1207; H01Q 1/1228; H01Q 1/1242; H01Q 1/125; H01Q 1/1264;

(Continued)

(56) References Cited

U.S. PATENT DOCUMENTS

| | | | |
|---|---|---|---|
| 2006/0077102 | A1 | 4/2006 | Mohamadi |
| 2008/0030416 | A1 | 2/2008 | Lee et al. |

(Continued)

FOREIGN PATENT DOCUMENTS

| | | | |
|---|---|---|---|
| CN | 2641843 | Y | 9/2004 |
| CN | 101427418 | A | 5/2009 |

(Continued)

*Primary Examiner* — Robert Karacsony

(74) *Attorney, Agent, or Firm* — Womble Bond Dickinson (US) LLP

(57) ABSTRACT

Embodiments of the present disclosure provide an antenna, including a first antenna portion and a detachable second antenna portion that is connected to the first antenna portion, where the first antenna portion includes a first radome and a first reflection plate disposed in the first radome, the second antenna portion includes a second radome and a second reflection plate disposed in the second radome, and a working surface of the first reflection plate and a working surface of the second reflection plate are coplanar; and a plurality of antenna arrays on the working surface of the first reflection plate and a plurality of antenna arrays on the working surface of the second reflection plate are configured to construct different types of antennas based on a quantity of frequency bands and a quantity of transmit and receive channels that are configured for the antenna.

18 Claims, 8 Drawing Sheets

(51) Int. Cl.
*H01Q 3/06* (2006.01)
*H01Q 5/45* (2015.01)

(52) U.S. Cl.
CPC ..... *H01Q 3/06* (2013.01); *H01Q 21/0025* (2013.01); *H01Q 21/061* (2013.01); *H01Q 21/28* (2013.01); *H01Q 5/45* (2015.01); *H01Q 21/0081* (2013.01)

(58) Field of Classification Search
CPC ..... H01Q 1/246; H01Q 1/42; H01Q 1/428; H01Q 3/04; H01Q 3/06; H01Q 3/08; H01Q 5/40; H01Q 5/42; H01Q 21/0025; H01Q 21/0081; H01Q 21/061; H01Q 21/08; H01Q 21/28; H01Q 21/293; H01Q 21/296
See application file for complete search history.

(56) References Cited

U.S. PATENT DOCUMENTS

2012/0014697 A1* 1/2012 Zhao ..... H04B 1/38 398/115
2012/0128040 A1 5/2012 Kenington
2014/0118196 A1 5/2014 Koskiniemi
2015/0222013 A1 8/2015 Choi et al.
2016/0099505 A1* 4/2016 Junttila ..... H01Q 19/10 455/562.1
2019/0123426 A1* 4/2019 Bryce ..... H01Q 1/22

FOREIGN PATENT DOCUMENTS

| | | | |
|---|---|---|---|
| CN | 201946739 | U | 8/2011 |
| CN | 102522634 | A | 6/2012 |
| CN | 102714345 | A | 10/2012 |
| CN | 102983387 | A | 3/2013 |
| CN | 103633452 | A | 3/2014 |
| CN | 205029023 | U | 2/2016 |
| CN | 105790860 | A | 7/2016 |
| EP | 3002822 | A1 | 4/2016 |
| WO | 2012103821 | A2 | 8/2012 |
| WO | 2017008264 | A1 | 1/2017 |
| WO | 2018140305 | A1 | 8/2018 |

* cited by examiner

ANTENNA, ANTENNA ASSEMBLY, AND BASE STATION

CROSS-REFERENCE TO RELATED APPLICATIONS

This application is a continuation of International Application No. PCT/CN2017/108366, filed on Oct. 30, 2017, the disclosure of which is hereby incorporated by reference in its entirety.

TECHNICAL FIELD

Embodiments of the present disclosure relate to the field of antenna technologies, and in particular, to an antenna, an antenna assembly, and a base station.

BACKGROUND

As network frequency bands increase, to implement a multiband multimode, and high-performance antenna of a base station in a network, a quantity of antenna combination modules of the base station increases. A combination module is an overall structure. A new module needs to be developed for each new combination, leading to a variety of spare parts. When a frequency band is upgraded and evolved, for example, 4 transmit, 4 receive (4T4R) is evolved to 8 transmit, 8 receive (8T8R), the entire antenna needs to be replaced, wasting customer investment.

SUMMARY

Embodiments of the present disclosure provide a combined antenna and an antenna base station, and modules in different frequency bands can be flexibly adapted on a same antenna, to facilitate replacement.

An embodiment of the present disclosure provides an antenna, including a first antenna portion and a second antenna portion, where the first antenna portion includes a first radome and a first reflection plate disposed in the first radome, the second antenna portion includes a second radome and a second reflection plate disposed in the second radome, the first radome is detachably connected to the second radome, and a working surface of the first reflection plate and a working surface of the second reflection plate are coplanar; and a plurality of antenna arrays on the working surface of the first reflection plate and a plurality of antenna arrays on the working surface of the second reflection plate are configured to construct different types of antennas based on a quantity of frequency bands and a quantity of transmit and receive channels that are configured. The first antenna portion and the second antenna portion are independently disposed, can implement antenna modules of at least two types of frequency bands, and can replace one of the antenna modules (antenna types) at any time and combine the antenna module with another antenna module to form a new antenna without updating the entire antenna, thereby reducing design complexity of the antenna, and improving manufacturability. In addition, another half of the modules can be reused, fully protecting investment value of a customer.

In one embodiment, the antenna arrays on the first reflection plate and the antenna arrays on the second reflection plate are configured to jointly construct a first-type antenna; or the antenna arrays on the first reflection plate are configured to construct a second-type antenna, and the antenna arrays on the second reflection plate are configured to construct a third-type antenna. The antenna in this embodiment has two or more types of antenna performance. The first-type antenna may be a low-frequency antenna. The second-type antenna and the third-type antenna are high-frequency antennas, and may be of a same frequency band or different frequency bands. The second-type antenna and the third-type antenna coexist or can work independently. Alternatively, the first-type antenna, the second-type antenna, and the third-type antenna coexist or perform respective operations.

In another embodiment, some antenna arrays on the first reflection plate and some antenna arrays on the second reflection plate are configured to jointly construct a first-type antenna, and some other antenna arrays on the first reflection plate and some other antenna arrays on the second reflection plate are respectively configured to construct a second-type antenna and a third-type antenna. Alternatively, some antenna arrays on the first reflection plate and the plurality of antenna arrays on the second reflection plate are configured to jointly construct the first-type antenna, and some other antenna arrays on the first reflection plate are configured to construct the second-type antenna. In this embodiment, the first-type antenna and the second-type antenna or the third-type antenna coexist or perform respective operations. The antenna may replace one type of antenna at any time and combine the antenna with another type of antenna to form a new antenna without updating the entire antenna, thereby reducing design complexity of the antenna, and improving manufacturability. In addition, another half of the modules can be reused, fully protecting investment value of a customer.

A phase shifter of the first-type antenna is connected to the antenna arrays that construct the first-type antenna, and are electrically connected to a first radio frequency port that is on the first radome by using the phase shifter, to construct the first-type antenna. The first-type antenna may be a low-frequency band antenna. A signal entered from the first radio frequency port is transmitted to the antenna arrays of the first-type antenna after the phase shifter adjusts a tilt angle of a wave for radiation.

In a direction from the first reflection plate to the second reflection plate, the antenna arrays on the first reflection plate and the antenna arrays on the second reflection plate that construct the first-type antenna are arranged on the working surface of the first reflection plate and the working surface of the second reflection plate at equal intervals in a straight line, and are connected to the phase shifter by using a power divider, to facilitate layout design of antenna arrays and ensure radiation effect.

A feeding network of the second-type antenna is electrically connected, by using a suspended strip-line structure, to the antenna arrays on the first reflection plate that construct the second-type antenna, and the feeding network is electrically connected to a second radio frequency port that is on the first radome.

A feeding network of the third-type antenna is electrically connected, by using a suspended strip-line structure, to the antenna arrays on the second reflection plate that construct the third-type antenna, and the feeding network is electrically connected to the second radio frequency port that is on the second radome. The feeding network of the third-type antenna is electrically connected, by using a suspended strip-line structure, to the antenna arrays on the second reflection plate that construct the third-type antenna. A second radio frequency module of the third-type antenna is disposed on a back of the first radome away from a radiation direction of the antenna, and the second radio frequency port that is on the second radome is electrically connected to the feeding network and the second radio frequency module. The second-type antenna and the third-type antenna may be high-frequency band antennas, and may alternatively be high-frequency antennas of a same frequency band or high-frequency antennas of different frequency bands. In addition to satisfying a column length of low-frequency band antenna arrays, the high-frequency band antenna compensates for a decrease in antenna array frequency caused by an insufficient column length of the high-frequency band antenna arrays by using a suspended strip-line structure feeding network, thereby ensuring respective performance of the low-frequency band antenna and the high-frequency band antenna.

The feeding network includes a power division module and a phase shift module, and the power division module is configured to connect to the phase shift module and the antenna arrays that correspond to the power division module. The power division module sets different line interfaces based on different interfaces and different quantities of antenna arrays required by the antenna, and adjusts a signal wave tilt angle by using the phase shift module.

When the first reflection plate or the second reflection plate includes both the antenna arrays of the first-type antenna and the antenna arrays of the second-type antenna, the antenna arrays of the first-type antenna and the antenna arrays of the second-type antenna are arranged in an interleaved manner, to fully use space of the reflection plates and facilitate design. In this embodiment, a quantity of second antenna arrays in a same column of a same reflection plate is twice a quantity of first antenna arrays. An interval between two antenna arrays of the second-type antenna is a half of an interval between two adjacent antenna arrays of the first-type antenna, and both arrangement of the low-frequency arrays and arrangement of the high-frequency arrays can be satisfied.

A blind-mate male connector is disposed on the first radome, a blind-mate female connector is disposed on the second radome, and the blind-mate male connector is plugged into the blind-mate male connector, to electrically connect the antenna arrays on the second reflection plate that construct the first-type antenna to the phase shifter. In the antenna arrays of the first-type antenna, the antenna arrays on the second reflection plate are electrically connected to the blind-mate female connector by using branch lines of a power divider, and are further connected to the phase shifter. The antenna arrays on the first reflection plate are all electrically connected to the phase shifter by using the power divider, that is, a small circuit board. This blind-mate interconnection manner is relatively simple.

The antenna arrays on the second reflection plate that construct the first-type antenna are connected to the phase shifter by using a jumper, and when there are a plurality of jumpers, lengths of the jumpers are the same. The power divider converges the branch lines that are connected to the plurality of antenna arrays into one branch line, and then the branch line is electrically connected to the phase shifter by using a jumper. This connection manner is simple.

A length and a width of the first reflection plate are the same as a length and a width of the second reflection plate, and a quantity and a column length of first antenna arrays on the first reflection plate are the same as a quantity and a column length of second antenna arrays on the second reflection plate. The first antenna arrays and the second antenna arrays are evenly arranged along a length direction of the first reflection plate and the second reflection plate, so that an appearance of the antenna is integral. In this embodiment, a sum of lengths of the first radome and the second radome is 2 m or 2.6 m, and the first radome and the second radome are evenly distributed. This length satisfies an arrangement length of a low-frequency band antenna array.

A size of antenna arrays of the second-type antenna and the third-type antenna is inversely proportional to a radio frequency of the antenna arrays, and a size of antenna arrays of the first-type antenna is inversely proportional to a radio frequency of the antenna arrays. The size and quantity of antenna arrays of the second-type antenna and the third-type antenna may be designed based on different design requirements of the radio frequency.

The first-type antenna includes a first radio frequency module disposed on a back of the first radome away from a radiation direction of the antenna; and the first radio frequency module is connected to the first radio frequency port of the first-type antenna by using a jumper, or the radio frequency module is connected to the first radio frequency port of the first-type antenna by using a connector. The antenna arrays of the first-type antenna receive a signal of the first radio frequency module and transmits the signal by using the first radio frequency port.

The second-type antenna includes a second radio frequency module disposed on a back of the first radome and/or the second radome away from a radiation direction of the antenna; and the second radio frequency module is connected to the second radio frequency port of the second-type antenna by using a jumper, or the second radio frequency module is connected to the second radio frequency port of the second-type antenna by using a connector. The antenna arrays of the second-type antenna receive a signal of the second radio frequency module and transmits the signal by using the second radio frequency port.

The first radome and the second radome have a same width; and the first radome and the second radome have a same length, and are arranged at intervals in a length direction. A gap error of a joint between the first radome and the second radome is less than or equal to 5 mm, to ensure that the first antenna arrays used as the first-type antenna can be arranged at equal intervals within a minimum error.

The first reflection plate is detachably slidably installed in the first radome, and the second reflection plate is detachably slidably installed in the second radome, so that the reflection plates can be replaced when antenna modules of different frequency bands need to be replaced. In this way, antenna arrays of different frequency bands can be replaced by replacing the reflection plates.

The antenna includes a connecting piece, and the connecting piece is fixedly connected to a back of the first antenna and a back of the second radome and is located on an end portion position of the first radome and the second radome, so that a working surface of the first reflection plate and a working surface of the second reflection plate are always coplanar; and the connecting piece is a handle, a connecting pole, or the like that is locked and kept between two radomes.

An embodiment of the present disclosure provides an antenna assembly, including the antenna and an antenna pole, where the antenna includes a connecting piece, and the connecting piece is fixedly connected to a back of the first antenna and a back of the second radome and is located on an end portion position of the first radome and the second radome, so that a working surface of the first reflection plate and a working surface of the second reflection plate are always coplanar; and the antenna pole includes a pole body, and an adjustment arm, a connecting arm, and a support arm that are sequentially fixed on the pole body along an axial direction of the pole body, where the adjustment arm is connected to an end portion of the second radome away from the connecting arm, the support arm is connected to an end portion on the first radome away from the connecting arm, to support a first antenna portion and a second antenna portion, the adjustment arm is extended and retracted to adjust tilt angles of the first antenna portion and the second antenna portion at the same time, and the connecting arm is adjustably connected to the connecting piece, so that the first antenna portion and the second antenna portion are always adjusted synchronously. Further, the connecting arm includes a connecting body fixed on the pole, a tilted sliding slot is disposed on the connecting body, a roll shaft is disposed on an end portion of the connecting piece, and the roll shaft is disposed in the sliding slot and slides or is locked in the sliding slot. When the tilt angle of the antenna needs to be adjusted, a length of the support arm is kept unchanged and the support arm is used as a fulcrum to extend or shorten the adjustment arm, and the connecting piece slides on the connecting arm, so that the first antenna portion and the second antenna portion are adapted to extension and retraction displacement of the adjustment arm and synchronous adjustment of the first antenna portion and the second antenna portion is ensured, thereby ensuring antenna performance.

The present disclosure provides a base station, including a base station support and the antenna assembly, where the pole is detachably fixed on the base station support at different angles. The base station can be adapted to configure antennas of different frequency band types by using the antenna assembly without replacing the entire antenna. Two modules of the antenna are stacked and assembled on one pole, so that a requirement for a site pole is reduced, and space of the base station and maintenance costs can be saved.

When the antenna described in this embodiment of the present disclosure can implement antenna performance of at least two types of frequency bands, one of the antenna modules can be replaced at any time to form a new antenna with another antenna module, and the entire antenna does not need to be updated. This facilitates operation and replacement.

DESCRIPTION OF EMBODIMENTS

Figure 1:
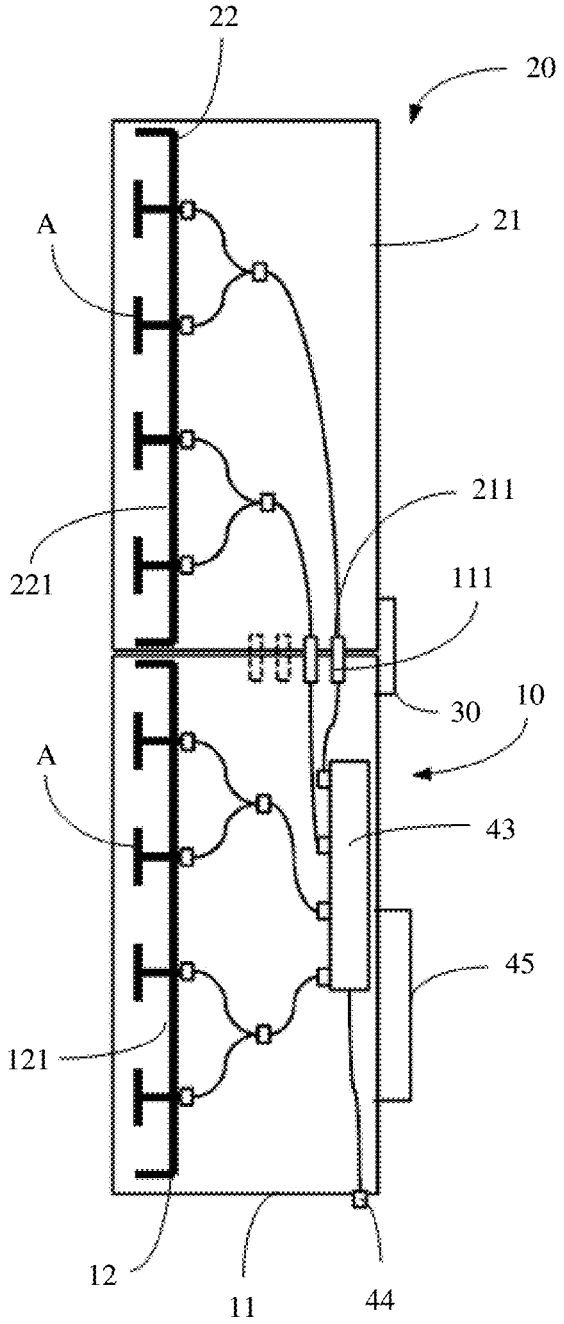
FIG. 1 is a schematic structural diagram of an internal surface of an antenna according to a first embodiment of the present disclosure.

The following clearly and completely describes the technical solutions in the embodiments of the present disclosure with reference to the accompanying drawings.

Embodiments of the present disclosure provide an antenna and a base station having the antenna. The base station may be a terminal network service station. An embodiment of the present disclosure describes an antenna according to an embodiment of the present disclosure, including a first antenna portion and a second antenna portion, where the first antenna portion includes a first radome and a first reflection plate disposed in the first radome, the second antenna portion includes a second radome and a second reflection plate disposed in the second radome, the first radome is detachably connected to the second radome, and a working surface of the first reflection plate and a working surface of the second reflection plate are coplanar; and a plurality of antenna arrays on the working surface of the first reflection plate and a plurality of antenna arrays on the working surface of the second reflection plate are configured to construct different types of antennas based on a quantity of frequency bands and a quantity of transmit and receive channels that are configured for the antenna.

In one embodiment, the antenna arrays on the first reflection plate and the antenna arrays on the second reflection plate are configured to jointly construct a first-type antenna; or the antenna arrays on the first reflection plate are configured to construct a second-type antenna, and the antenna arrays on the second reflection plate are configured to construct a third-type antenna. The antenna in this embodiment has two or more types of antenna performance. The first-type antenna may be a low-frequency antenna. The second-type antenna and the third-type antenna are high-frequency antennas, and may be of a same frequency band or different frequency bands. The second-type antenna and the third-type antenna coexist or can work independently. Alternatively, the first-type antenna, the second-type antenna, and the third-type antenna coexist or perform respective operations.

In another embodiment, some antenna arrays on the first reflection plate and some antenna arrays on the second reflection plate are configured to jointly construct a first-type antenna, and some other antenna arrays on the first reflection plate and some other antenna arrays on the second reflection plate are respectively configured to construct a second-type antenna and a third-type antenna. Alternatively, some antenna arrays on the first reflection plate and the plurality of antenna arrays on the second reflection plate are configured to jointly construct the first-type antenna, and some other antenna arrays on the first reflection plate are configured to construct the second-type antenna.

The first antenna portion and the second antenna portion are independently disposed, can implement antenna modules of at least two types of frequency bands, and can replace one of the antenna modules (antenna types) at any time and combine the antenna module with another antenna module to form a new antenna without updating the entire antenna, enhance modular combination to adapt to diversity of site antennas, reduce design complexity of the antenna, and improve manufacturability. In addition, another half of the modules can be reused, fully protecting investment value of a customer.

The following describes the antenna in the present disclosure with reference to specific embodiments. Referring to FIG. 1, in an embodiment of the present disclosure, the antenna includes a first antenna portion 10 and a second antenna portion 20 detachably connected to the first antenna portion 10. The first antenna portion 10 includes a first radome 11 and a first reflection plate 12 disposed in the first radome 11; the second antenna portion 20 includes a second radome 21 and a second reflection plate 22 disposed in the second radome 21. Specifically, the first radome 11 is detachably connected to the second radome 21, so that a working surface 121 of the first reflection plate 12 and a working surface 221 of the second reflection plate 22 are coplanar. The working surface 121 of the first reflection plate 12 and the working surface 221 of the second reflection plate 22 each are provided with several arrayed antenna arrays.

The first radome 11 and the second radome 21 may be transparent radomes of a box-shaped structure, accommodate array reflection plates constructing the antenna, and can bearer a radio frequency module adapted to the antenna. A radio frequency port of the antenna may be disposed on the radome. Alternatively, the first radome 11 and the second radome 21 may be slot-shaped transparent radomes that are fastened to a radio frequency module assembly of the antenna to form a box-shaped structure as a complete radome, to accommodate the reflection plates and arrays of the antenna, and the radio frequency port can be directly disposed on the radio frequency module assembly. In this embodiment of the present disclosure, an example in which the first radome 11 and the second radome 21 are of a box-shaped structure is used for description. Components such as a reflection plate, an antenna array, a radio frequency port, and a phase shifter of the antenna are disposed in the radome. The detachable connection between the first antenna portion 10 and the second antenna portion 20 is specifically connecting the first radome 11 to the second radome 21 by using a connecting component. In this embodiment, sizes of the first radome 11 and the second radome 22 are the same at least in width, and lengths of the first radome 11 and the second radome 22 are also the same in this embodiment. This may be understood as two radomes having the same sizes. In addition, the first radome 11 and the second radome 21 are arranged in a length direction. In this way, the entire antenna may look relatively clean and have an integrated and beautiful effect, and when the antenna is installed on a base station, space of the base station may be fully used. Certainly, two radomes of different sizes may alternatively be designed based on a requirement such as the space of the base station. Further, a gap error of a joint between the first radome 11 and the second radome 21 is less than or equal to 5 mm, to ensure that antenna arrays used as a first-type antenna can be arranged at equal intervals within a minimum error. In another embodiment, the radome is a transparent radome having a slot-shaped structure, and is combined and connected to a radio frequency module assembly. Sizes of the first radome 11 and the second radome 22 are also the same at least in width, and lengths of the first radome 11 and the second radome 22 are also the same.

In this embodiment, the first reflection plate 12 is detachably installed in the first radome 11, and the second reflection plate 22 is detachably installed in the second radome 21. Sliding may be implemented by using a simplest of fitting between a reflection plate and a sliding slot. Further, the antenna includes a connecting piece 30, where the connecting piece 30 is fixedly connected to a back of the first radome 11 and a back of the second radome 21 and is located at a connection position between the first radome 11 and the second radome 12, so that the working surface 121 of the first reflection plate 12 and the working surface 221 of the second reflection plate 22 are always coplanar, that is, are on a same plane.

The connecting piece 30 may be a sucked type structure that is locked between the first radome 11 and the second radome 12, a handle, or a connecting pole that connects to the first radome 11 to the second radome 12. A roller is disposed at an end of the connecting piece 30, and is configured to connect to a pole that supports the antenna. The connecting piece 30 may be separately detached from the first radome 11 or the second radome 12, to replace the first antenna portion 10 or the second antenna portion 20. Further, to reduce a gap at a connection position between the first radome 11 and the second radome 12, a fastener is disposed on the connecting piece 30, and the fastener presses the connecting piece 30 to be fixed to two parts of the first radome 11 and the second radome 12, so that the first radome 11 and the second radome 12 are connected more closely.

Figure 8:
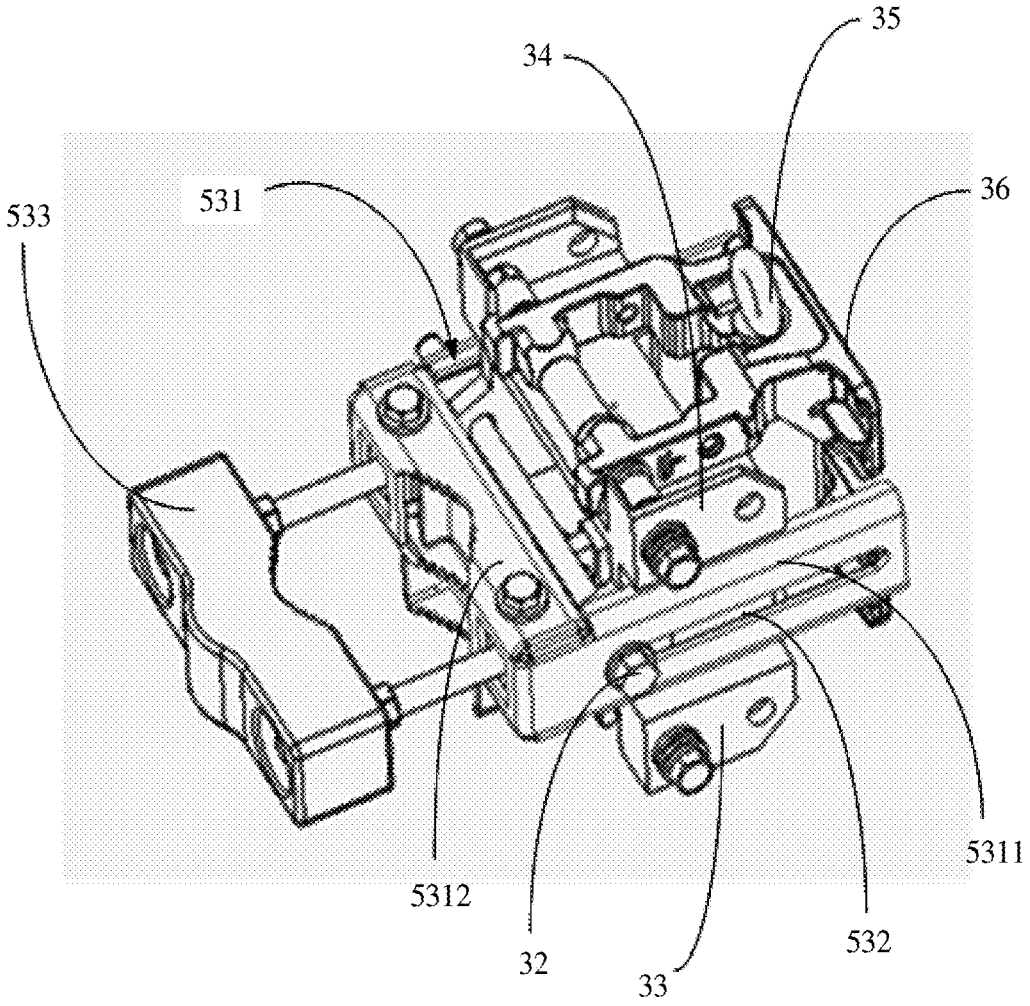
FIG. 8 is a schematic structural diagram of a combination of a connecting piece and a connecting arm of an antenna according to the present disclosure.

Referring to FIG. 8, in this embodiment, the connecting piece 30 includes a substrate (not shown) provided with a roller 32, a first fastening portion 33, a second fastening portion 34, and a fastener 35 that connects the first fastening portion 33 to the second fastening portion 34. The first fastening portion 33 and the second fastening portion 34 are respectively connected to two opposite sides of the substrate, and the fastener 35 passes through the substrate, the first fastening portion 33, and the second fastening portion 34, and locks the first fastening portion 33 and the second fastening portion 34 towards the substrate. A connecting plate 36 is disposed at an end of both the first fastening portion 33 and the second fastening portion 34, and is configured to be fixedly connected to the first radome 11 and the second radome 21.

In a first embodiment of the present disclosure, the antenna arrays on the first reflection plate 12 and the second reflection plate 22 are first antenna arrays A of a first-type antenna jointly constructed by the first antenna portion 10 and the second antenna portion 20, that is, the first antenna portion 10 and the second antenna portion 20 jointly construct the antenna, a quantity and an arrangement of the antenna arrays conform to a quantity of frequency bands and a quantity of transmit and receive channels that are configured for the antenna in this embodiment. Further, the first-type antenna includes a first radio frequency module 45 disposed on a back of the first radome 11 away from a radiation direction of the antenna; and the first radio frequency module 45 is connected to a first radio frequency port 44 of the first-type antenna by using a jumper, or the radio frequency module 45 is connected to the first radio frequency port of the first-type antenna by using a connector, to adapt to connections of radio frequency modules having different quantities of transmit and receive channels. The first radio frequency module 45 implements signal transmitting and receiving of the first antenna arrays A by using the first radio frequency port 44, where a phase shifter is used to adjust a signal beam downtilt angle. In this embodiment, the first antenna arrays A of the first-type antenna are set based on the frequency bands and the quantity of transmit and receive channels of the first radio frequency module 45 that are configured for the antenna.

In a direction from the first reflection plate 12 to the second reflection plate 22, the first antenna arrays A are arranged on the working surface of the first reflection plate 12 and the working surface of the second reflection plate 22 at equal intervals in a straight line. In this embodiment, a column length of some first antenna arrays on the first reflection plate is the same as a column length of some other first antenna arrays on the second reflection plate. In this way, this arrangement facilitates antenna design and manufacturing process of the antenna. In this embodiment, a phase shifter 43 of the first-type antenna is disposed in the first radome 11, and the first antenna arrays A is electrically connected to the first radio frequency port 44 that is on the first radome 11 by using the phase shifter 43. In another embodiment, a length of the first antenna portion 10 may be unequal to a length of the second antenna portion 20, that is, a length of the first radome is unequal to a length of the second radome, and a column length of the antenna arrays on the first reflection plate 12 may alternatively be unequal to a column length of the antenna arrays on the second reflection plate 22.

In this embodiment, the first-type antenna is a low-frequency antenna, the first antenna arrays A are low-frequency antenna arrays, and a radio frequency of the first antenna arrays A is 1710 GHz to 2610 GHz. A size of the first antenna arrays A is inversely proportional to a radio frequency of the first antenna arrays A. A sum of lengths of the first radome 11 and the second radome 21 is 2 m, and lengths of the first radome 11 and the second radome 21 are 1 m. In another embodiment, the lengths of the first radome 11 and the second radome 21 are 1.3 m. In this embodiment, there are eight first antenna arrays A, and the eight first antenna arrays A are evenly distributed on the first reflection plate 12 and the second reflection plate 22. Cabling of every two first antenna arrays is combined into one branch line by using PCB, and is connected to an interface on the phase shifter. When an antenna interface needs to be upgraded, for example, when a quantity of antenna arrays A is increased to replace a 2 m antenna with a 2.6 m antenna, the entire antenna does not need to be discarded, and only the first antenna portion 10 or the second antenna portion 20 needs to be replaced, or even only the bearer first reflection plate or the second reflection plate needs to be replaced. This is easy to operate, and costs are reduced.

In this embodiment, a blind-mate male connector 111 is disposed on the first radome 11, a blind-mate female connector 211 is disposed on the second radome 21, and the blind-mate male connector 111 is plugged into the blind-mate male connector 211, to electrically connect the first antenna arrays A on the second reflection plate 12 to the phase shifter 43. This blind-mate interconnection manner is relatively simple.

Figure 2:
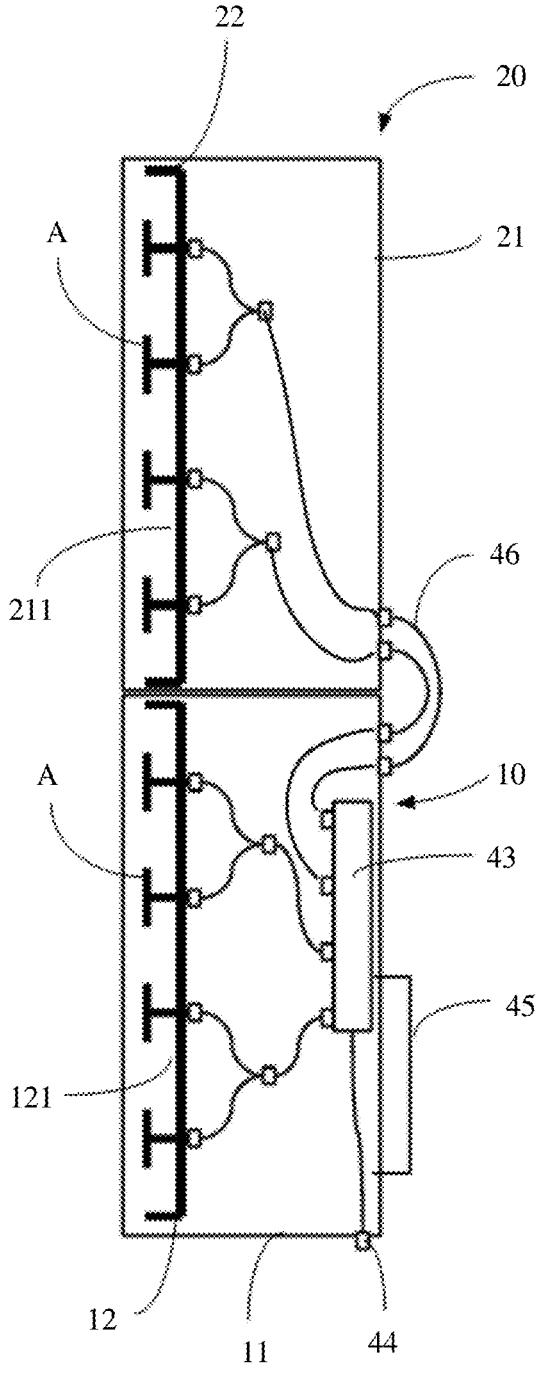
FIG. 2 is a schematic diagram of another manner of connecting a first antenna portion to a second antenna portion of the antenna shown in FIG. 1.

As shown in FIG. 2, certainly, the first antenna arrays A that are on the second reflection plate 22 are connected to the phase shifter 43 by using a jumper 46, and when there are a plurality of jumpers 46, lengths of the jumpers are the same. The power divider converges the branch lines that are connected to the first antenna arrays A into one branch line, and then the branch line is electrically connected to the phase shifter 43 by using a jumper. This connection manner is simple.

Figure 3:
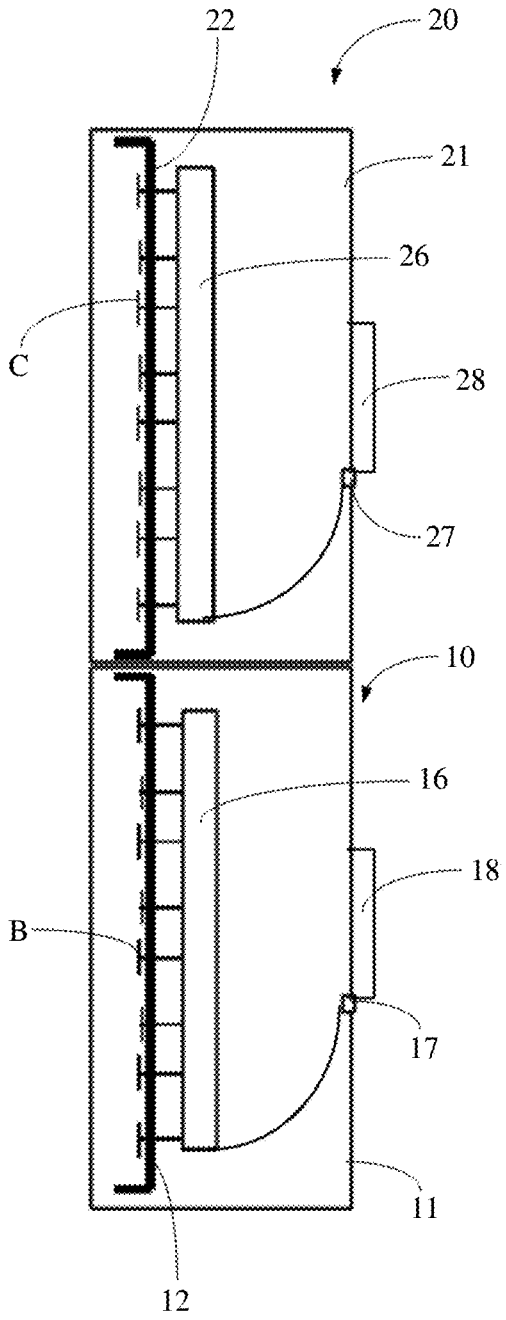
FIG. 3 is a schematic structural diagram of an internal surface of an antenna according to a second embodiment of the present disclosure.

Referring to FIG. 3, in a second embodiment of the present disclosure, what is different from the foregoing embodiment is that antenna arrays on the first reflection plate 12 and antenna arrays on the second reflection plate 22 are second antenna arrays B of a second-type antenna and third antenna arrays C of a third-type antenna that are respectively and independently constructed by the first antenna portion 10 and the second antenna portion 20. That is, the first antenna portion 10 and the second antenna portion 20 respectively construct the second-type antenna and the third-type antenna, and the second-type antenna and the third-type antenna may operate independently, or may operate together. The antenna arrays used as the second antenna arrays B are set based on a quantity of frequency bands and a quantity of transmit and receive channels of a radio frequency module that are configured for the second-type antenna. The antenna arrays used as the third antenna arrays C are the antenna arrays that are set based on and a quantity of frequency bands and a quantity of transmit and receive channels of a radio frequency module that are configured for the third-type antenna and that are of two different types, and are respectively disposed on the first reflection plate 12 and the second reflection plate 22. A radio frequency of the first antenna arrays A is different from a radio frequency of the second antenna arrays B. In this embodiment, the second antenna arrays B are high-frequency band antenna arrays. The quantity and arrangement of the second antenna arrays B on the first reflection plate 12 and the third antenna arrays C on the second reflection plate 22 may be the same or different, to adapt to different multi-dimensional radio frequency adjustments. A size of the second antenna arrays is inversely proportional to a radio frequency of the second antenna arrays, and frequencies of the second antenna arrays B and the third antenna arrays C may be set based on an actual requirement. For example, the second-type antenna constructed by the first antenna portion 10 is in an 8T8R mode, and the third-type antenna constructed by the second antenna portion 20 is in a 4T4R mode or an 8T8R mode, or may be in a 32T32R mode.

The second-type antenna includes a feeding network that is electrically connected, by using a suspended strip-line structure, to a plurality of the second antenna arrays B, and the feeding network is connected to a second radio frequency port on a radome corresponding to the second-type antenna. The feeding network includes a power division module and a phase shift module. The power division module is connected to corresponding second-type antenna arrays and the phase shift module. The power division module is disposed at a port corresponding to the second antenna arrays or a port of a second antenna array branch line, and is configured to implement a connection between the second antenna arrays B and the phase shift module. The phase shift module adjusts a phase of a signal wave. In this embodiment, the second-type antenna constructed by the first antenna portion 10 includes a feeding network 16 disposed in the first radome 11 and a radio frequency port 17 that is on the first radome 11 and that is connected to the feeding network 16.

The third-type antenna includes a feeding network in a suspended strip-line structure that is electrically connected to a plurality of the third antenna arrays C, and the feeding network is connected to a second radio frequency port on a radome corresponding to the third-type antenna. The feeding network includes a power division module and a phase shift module. The power division module is connected to corresponding third-type antenna arrays and the phase shift module. The power division module is disposed at a port corresponding to the third antenna arrays or a port of a third antenna array branch line, and is configured to implement a connection between the third antenna arrays C and the phase shift module. The phase shift module adjusts a phase of a signal wave. In this embodiment, the second-type antenna constructed by the second antenna portion 20 includes a feeding network 26 disposed in the second radome 21 and a second radio frequency port 27 that is on the second radome 21 and that is connected to the feeding network 26. The second-type antenna and the third-type antenna are high-frequency antennas, and an antenna array of a high-frequency band antenna compensates for a decrease in frequency of the antenna array caused by an insufficient column length of the antenna array of the high-frequency band by using a suspended strip-line structure feeding network, thereby ensuring respective performance of a low-frequency band antenna and a high-frequency band antenna.

Further, the second-type antenna includes a second radio frequency module disposed on a back of the first radome away from a radiation direction of the antenna; and the second radio frequency module is connected to the radio frequency port of the second-type antenna by using a jumper, or the second radio frequency module is connected to the radio frequency port of the second-type antenna by using a connector. In this embodiment, the second-type antenna constructed by the first antenna portion 10 includes a second radio frequency module 18 disposed on the back of the first radome 11 away from a radiation direction of the antenna. The third-type antenna constructed by the second antenna portion 20 includes a second radio frequency module 28 disposed on the back of the second radome 21 away from a radiation direction of the antenna. A radio frequency port corresponding to the radio frequency module is connected by using a jumper (not shown in the figure). The radio frequency module transmits a signal to the feeding network by using the radio frequency port, and after being adjusted by the phase shift module, the signal is transmitted by the power division module to each antenna array for radiation. The antenna described in this embodiment includes two groups of independent second-type antennas and third-type antennas that are easily to be replaced and that have a same or different module architectures. The two groups of independent second-type antennas and third-type antennas can respectively adapt to requirements of radio frequency modules with different quantities of transmit and receive channels, enhance multi-dimensional adjustment of the antenna, enhance modular combination to adapt to diversity of site antennas, and reduce types of accessories such as the antenna and the phase shifter. In addition, each sub-antenna can be maintained independently.

Figure 4:
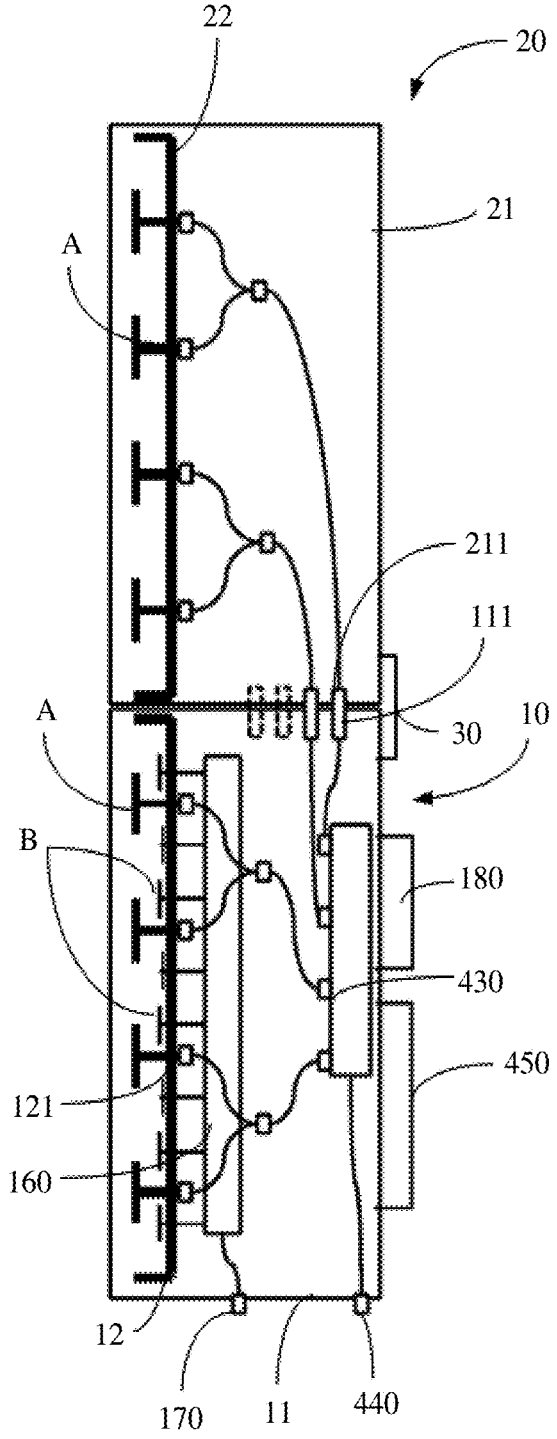
FIG. 4 is a schematic structural diagram of an internal surface of an antenna according to a third embodiment of the present disclosure.

Referring to FIG. 4, in a third embodiment of the present disclosure, what is different from the first embodiment is that some antenna arrays on the first reflection plate and a plurality of antenna arrays on the second reflection plate are used to jointly construct a first-type antenna, that is, when some antenna arrays on the first reflection plate 12 and antenna arrays on the second reflection plate 22 are used as first antenna arrays A of the jointly constructed first-type antenna, some antenna arrays on the first reflection plate 12 are used as second antenna arrays B of the second-type antenna. That is, some antenna arrays on the first reflection plate 12 and the antenna arrays on the second reflection plate 22 are set based on a quantity of frequency bands and a quantity of transmit and receive channels of the radio frequency module configured by the first-type antenna in this embodiment. The antenna arrays of the second antenna arrays B are set based on a quantity of frequency bands and a quantity of transmit and receive channels of a radio frequency module that are configured for the second-type antenna. The plurality of antenna arrays on the first reflection plate 12 are two types of antenna arrays and are arranged in respective forms, and the plurality of antenna arrays on the second reflection plate 22 are arrays that are of the same type of some antenna arrays on the first reflection plate 12, to jointly construct the first antenna arrays A. The antenna in this embodiment includes the first-type antenna and the second-type antenna. On the first antenna portion 10, the second-type antenna constructed by some other antenna arrays on the first reflection plate 12 includes a feeding network 160 disposed in the first radome 11, a second radio frequency port 170 that is on the first radome 11 and that is connected to the feeding network 160, and a second radio frequency module 180 connected to the second radio frequency port 170. The second radio frequency port 170 in this embodiment is connected to the second radio frequency module 180 by using a jumper. The phase shifter 430 of the first type of antenna is disposed in the first radome 11 and is connected to the first antenna arrays A, and the phase shifter 430 is connected to a radio frequency port 440 on the first radome 11, where the radio frequency port 440 is connected to a radio frequency module 450 that matches the first-type antenna. The first-type antenna is a low-frequency antenna, and may be an active antenna or a passive antenna. The second-type antenna is a high-frequency antenna, and may be an active antenna or a passive antenna.

Figure 5:
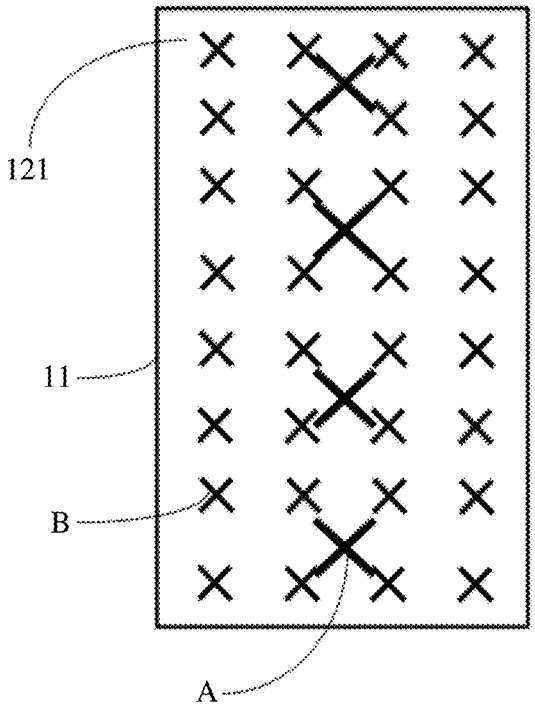
FIG. 5 is a schematic diagram of a front surface of a first reflection plate of the antenna shown in FIG. 4.

Referring to FIG. 5 together, the first antenna arrays A and the second antenna arrays B are evenly arranged along a length direction of the first reflection plate 12 and a length direction of the second reflection plate 22. Both the first antenna arrays A and the second antenna arrays B are disposed on the first reflection plate 12, and the first antenna arrays A are arranged in an interleaved manner between the second antenna arrays B in a same column. Such arrangement makes full use of the reflection plate and simplifies array arrangement design. In this embodiment, an interval between the two adjacent second antenna arrays B is half of an interval between the two adjacent first antenna arrays A, to satisfy a requirement of an interval between the high-frequency antenna and the low-frequency antenna arrays.

Figure 6:
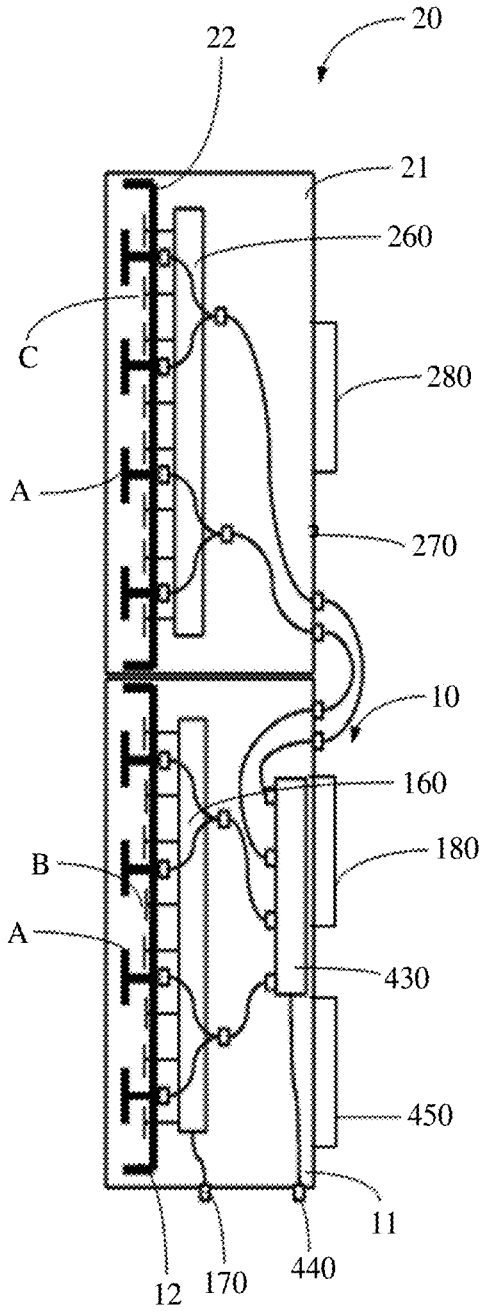
FIG. 6 is a schematic structural diagram of an internal surface of an antenna according to a fourth embodiment of the present disclosure.

Referring to FIG. 6, in a fourth embodiment of the present disclosure, what is different from the third embodiment is that on a basis of the third embodiment, some antenna arrays on the first reflection plate and some antenna arrays on the second reflection plate are configured to jointly construct a first-type antenna, some other the antenna arrays on the first reflection plate and some other antenna arrays on the second reflection plate are respectively configured to construct a second-type antenna and a third-type antenna. The second-type antenna and the third-type antenna may have a frequency band difference. The second-type antenna and the third-type antenna are high-frequency antennas of different frequency bands, and certainly may alternatively be high-frequency antennas of a same frequency band. That is, the plurality of antenna arrays on the first reflection plate 12 are two types of antenna arrays arranged in respective forms, and the plurality of antenna arrays on the second reflection plate 22 are two types of antenna arrays arranged in respective forms. Some antenna arrays of a same type on the working surface of the first reflection plate 12 and the working surface of the second reflection plate 22 are jointly the first antenna arrays A of the first-type antenna, some antenna arrays of a same type on the working surface of the first reflection plate 12 are jointly the second antenna arrays B of the second-type antenna, and some antenna arrays on the working surface of the second reflection plate 22 are the third antenna arrays C of the third-type antenna. The second-type antenna includes the feeding network 160, the radio frequency port 170 connected to the feeding network 160, and the radio frequency module 180 connected to the radio frequency port 170. The second-type antenna includes the feeding network 260, the radio frequency port 270 connected to the feeding network 260, and the radio frequency module 280 connected to the radio frequency port 270.

Figure 7:
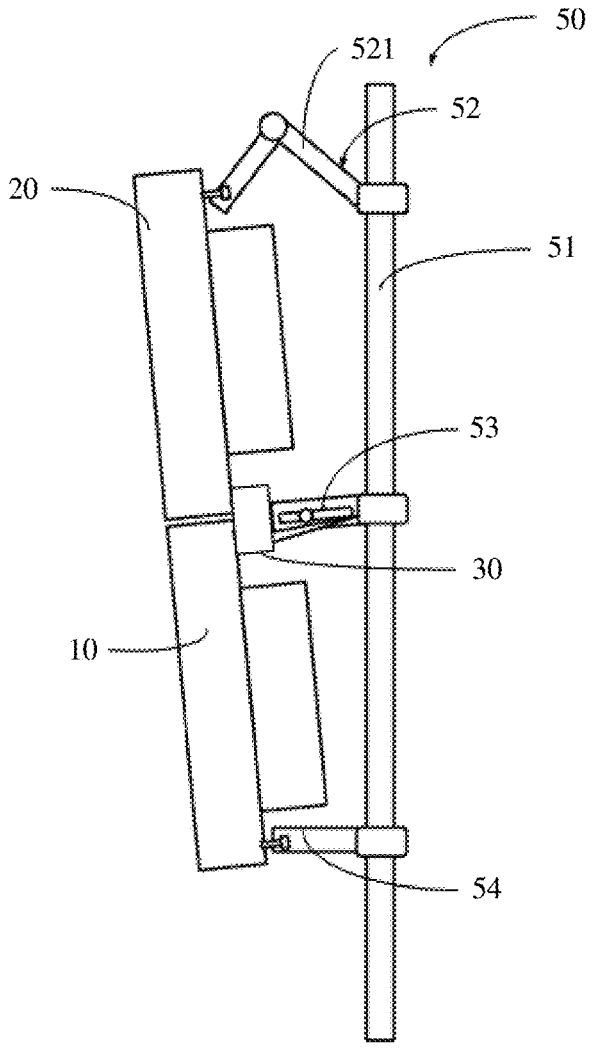
FIG. 7 is a schematic diagram of an antenna assembly according to the present disclosure.

Referring to FIG. 7, the present disclosure further provides an antenna assembly, including the antenna and an antenna pole 50, where the antenna includes a connecting piece 30, and the connecting piece 30 is fixedly connected to a back of the first radome 11 and a back of the second radome 21 and is located on an end portion position of the first radome and the second radome, so that the working surface of the first reflection plate 12 and the working surface of the second reflection plate 22 are always coplanar. Therefore, antenna performance of the foregoing first-type antenna can be ensured.

The antenna pole 50 includes a pole body 51, and an adjustment arm 52, a connecting arm 53, and a support arm 54 that are sequentially fixed on the pole body 51 along an axial direction of the pole body 51, where the adjustment arm 52 is connected to an end portion of the second radome 21 away from the connecting arm 53, the support arm 54 is connected to an end portion on the first radome 11 away from the connecting arm 53, to support the first antenna portion 10 and the second antenna portion 20, the adjustment arm 52 is extended and retracted to adjust tilt angles of the first antenna portion 10 and the second antenna portion 20 at the same time, and the connecting arm 53 is adjustably connected to the connecting piece 30, so that the first antenna portion 10 and the second antenna portion 20 are always adjusted synchronously. The antenna is fixed on the pole by using three mounting points: the adjustment arm 52, the connecting arm 53 connected to the connecting piece, and the support arm 54, to achieve stable balance, and the first antenna portion and the second antenna portion may be separated independently.

In this embodiment, the adjustment arm 52 includes two arm bodies 521 that are rotated and connected by using a rotating shaft. A free end portion of one arm body 521 is detachably fixed on the pole 51, and a free end portion of the other arm body 521 is detachably fixed on a back end portion of the second radome 21. The two arm bodies 521 are extended or shortened by rotating the rotating shaft relative to each other. One end portion of the support arm 54 is detachably fixed on the pole 51, and another end portion of the support arm 54 is detachably fixed on one end portion of the back of the first radome 11 away from the second radome 21. In addition, when the adjustment arm 52 adjusts angles of the first antenna portion 10 and the second antenna portion 20, the support arm 54 enables the second radome 21 to move with the angles. For example, the support arm 54 and the first radome 11 are locked by using a rotating shaft and a nut, and an angle at which the first radome 11 is fixed may be manually adjusted by using the nut.

Referring to FIG. 8, the connecting arm 53 includes a connecting body 531 fixed to the pole 51, where a tilted sliding slot 532 is disposed on the connecting body 531, and a roller shaft 32 of the connecting piece 30 is disposed in the sliding slot 532 and slides or is locked in the sliding slot 532. Specifically, a nut may be used for locking. The first antenna portion 10 and the second antenna portion 20 are adjusted with an angle of the adjustment arm 52 by adjusting a position of the roller shaft of the connecting piece 30 in the sliding slot 532. The connecting arm 53 further includes a lock catch 533. The connecting body 531 is of a frame structure, and includes two extension plates and a connecting plate 5312 connected to the two extension plates 5311. The sliding slot 532 is disposed on the extension plates 5311. The lock catch 533 is connected to the connecting plate 5312 by using a bolt, to be clamped on the pole.

The present disclosure further provides a base station, including a base station support and the antenna assembly, where the pole is detachably fixed on the base station support at different angles. The base station is stacked and assembled for two modules by using an antenna on the antenna assembly, so that the base station can be adapted to configure radio frequency antennas of different frequency bands and different dimensions without replacing the entire antenna. In addition, as long as the base station is implemented on one pole, a requirement for a site pole is reduced, and space of the base station and maintenance costs can be saved.

The foregoing descriptions are examples of embodiments of the present disclosure. It should be noted that a person of ordinary skill in the art may make several improvements and polishing without departing from the principle of the present disclosure and the improvements and polishing shall fall within the protection scope of the present disclosure.

What is claimed is:

1. An antenna, comprising:

a first antenna portion; and a detachable second antenna portion that is connected to the first antenna portion, wherein the first antenna portion comprises a first radome and a first reflection plate disposed in the first radome, the second antenna portion comprises a second radome and a second reflection plate disposed in the second radome; and a plurality of antenna arrays on a working surface of the first reflection plate and a plurality of antenna arrays on a working surface of the second reflection plate are configured to construct different types of antennas based on a quantity of frequency bands and a quantity of transmit and receive channels that are configured for the antenna, wherein some antenna arrays on the first reflection plate and the plurality of antenna arrays on the second reflection plate are configured to jointly construct a first-type antenna, and some other antenna arrays on the first reflection plate are configured to construct a second-type antenna.

2. The antenna according to claim 1, wherein a phase shifter of the first-type antenna is connected to the antenna arrays that construct the first-type antenna, and is electrically connected to a first radio frequency port that is on the first radome by using the phase shifter.

3. The antenna according to claim 2, wherein in a direction from the first reflection plate to the second reflection plate, the antenna arrays on the first reflection plate and the antenna arrays on the second reflection plate that construct the first-type antenna are arranged on the working surface of the first reflection plate and the working surface of the second reflection plate at equal intervals in a straight line, and are connected to the phase shifter by using a power divider.

4. The antenna according to claim 2, wherein the antenna arrays on the second reflection plate that construct the first-type antenna are connected to the phase shifter by using a jumper, and when there are a plurality of jumpers, lengths of the jumpers are the same.

5. The antenna according to claim 1, wherein a length and a width of the first reflection plate are the same as a length and a width of the second reflection plate, and a quantity and a column length of first antenna arrays on the first reflection plate are the same as a quantity and a column length of second antenna arrays on the second reflection plate.

6. The antenna according to claim 2, wherein the first-type antenna comprises a first radio frequency module disposed on a back of the first radome away from a radiation direction of the antenna; and the first radio frequency module is connected to a first radio frequency port of the first-type antenna by using a jumper, or the first radio frequency module is connected to the first radio frequency port of the first-type antenna by using a connector.

7. The antenna according to claim 1, wherein a gap error of a joint between the first radome and the second radome is less than or equal to 5 mm.

8. The antenna according to claim 1, wherein the first reflection plate is detachably slidably installed in the first radome, and the second reflection plate is detachably slidably installed in the second radome.

9. The antenna according to claim 1, wherein the antenna comprises a connecting piece, and the connecting piece is fixedly connected to a back of the first radome and a back of the second radome.

10. An antenna, comprising:

a first antenna portion; and a detachable second antenna portion that is connected to the first antenna portion, wherein the first antenna portion comprises a first radome and a first reflection plate disposed in the first radome, the second antenna portion comprises a second radome and a second reflection plate disposed in the second radome; and a plurality of antenna arrays on a working surface of the first reflection plate and a plurality of antenna arrays on a working surface of the second reflection plate are configured to construct different types of antennas based on a quantity of frequency bands and a quantity of transmit and receive channels that are configured for the antenna, wherein some antenna arrays on the first reflection plate and some antenna arrays on the second reflection plate are configured to jointly construct a first-type antenna, and some other antenna arrays on the first reflection plate and some other antenna arrays on the second reflection plate are respectively configured to construct a second-type antenna and a third-type antenna.

11. An antenna, comprising:

a first antenna portion; and a detachable second antenna portion that is connected to the first antenna portion, wherein the first antenna portion comprises a first radome and a first reflection plate disposed in the first radome, the second antenna portion comprises a second radome and a second reflection plate disposed in the second radome; and a plurality of antenna arrays on a working surface of the first reflection plate and a plurality of antenna arrays on a working surface of the second reflection plate are configured to construct different types of antennas based on a quantity of frequency bands and a quantity of transmit and receive channels that are configured for the antenna, wherein the antenna arrays on the first reflection plate and the antenna arrays on the second reflection plate are configured to jointly construct a first-type antenna; or the antenna arrays on the first reflection plate are configured to construct a second-type antenna, and the antenna arrays on the second reflection plate are configured to construct a third-type antenna, wherein a feeding network of the second-type antenna is electrically connected, by using a suspended strip-line structure, to the antenna arrays on the first reflection plate that construct the second-type antenna, and the feeding network is electrically connected to a second radio frequency port that is on the second radome.

12. The antenna according to claim 11, wherein a feeding network of the third-type antenna is electrically connected, by using a suspended strip-line structure, to the antenna arrays on the second reflection plate that construct the third-type antenna, a second radio frequency module of the third-type antenna is disposed on a back of the first radome away from a radiation direction of the antenna, and the second radio frequency port that is on the second radome is electrically connected to the feeding network and the second radio frequency module.

13. The antenna according to claim 11, wherein the feeding network comprises a power division module and a phase shift module, and the power division module is configured to connect to the phase shift module and the antenna arrays that correspond to the power division module.

14. The antenna according to claim 11, wherein the second-type antenna comprises a second radio frequency module disposed on a back of the first radome away from a radiation direction of the antenna; and the second radio frequency module is connected to a second radio frequency port of the second-type antenna by using a jumper, or the second radio frequency module is connected to a second radio frequency port of the second-type antenna by using a connector.

15. An antenna, comprising:

a first antenna portion; and a detachable second antenna portion that is connected to the first antenna portion, wherein the first antenna portion comprises a first radome and a first reflection plate disposed in the first radome, the second antenna portion comprises a second radome and a second reflection plate disposed in the second radome; and a plurality of antenna arrays on a working surface of the first reflection plate and a plurality of antenna arrays on a working surface of the second reflection plate are configured to construct different types of antennas based on a quantity of frequency bands and a quantity of transmit and receive channels that are configured for the antenna, wherein the antenna arrays on the first reflection plate and the antenna arrays on the second reflection plate are configured to jointly construct a first-type antenna; or the antenna arrays on the first reflection plate are configured to construct a second-type antenna, and the antenna arrays on the second reflection plate are configured to construct a third-type antenna, wherein a phase shifter of the first-type antenna is connected to the antenna arrays that construct the first-type antenna, and is electrically connected to a first radio frequency port that is on the first radome by using the phase shifter, wherein a blind-mate male connector is disposed on the first radome, a blind-mate female connector is disposed on the second radome, and the blind-mate male connector is plugged into the blind-mate female connector.

16. An antenna assembly, comprising:

an antenna comprising a first antenna portion and a detachable second antenna portion that is connected to the first antenna portion; and an antenna pole, wherein:

the first antenna portion comprises a first radome and a first reflection plate disposed in the first radome, the second antenna portion comprises a second radome and a second reflection plate disposed in the second radome, a plurality of antenna arrays on a working surface of the first reflection plate and a plurality of antenna arrays on a working surface of the second reflection plate are configured to construct different types of antennas based on a quantity of frequency bands and a quantity of transmit and receive channels that are configured for the antenna, wherein some antenna arrays on the first reflection plate and the plurality of antenna arrays on the second reflection plate are configured to jointly construct a first-type antenna, and some other antenna arrays on the first reflection plate are configured to construct a second-type antenna, the antenna further comprises a connecting piece, and the connecting piece is fixedly connected to a back of the first antenna radome and a back of the second radome and is located on an end portion position of the first radome and the second radome, and the antenna pole comprises a pole body, and an adjustment arm, a connecting arm, and a support arm that are sequentially fixed on the pole body along an axial direction of the pole body, wherein the adjustment arm is connected to an end portion of the second radome away from the connecting arm, the support arm is connected to an end portion on the first radome away from the connecting arm, to support the first antenna portion and the second antenna portion, the adjustment arm is extended and retracted to adjust tilt angles of the first antenna portion and the second antenna portion at the same time, and the connecting arm is adjustably connected to the connecting piece, so that the first antenna portion and the second antenna portion are always adjusted synchronously.

17. The antenna assembly according to claim 16, wherein the connecting arm comprises a connecting body fixed on the antenna pole, a tilted sliding slot is disposed on the connecting body, a roll shaft is disposed on an end portion of the connecting piece, and the roll shaft is disposed in the sliding slot and slides or is locked in the sliding slot.

18. A base station, comprising:

a base station support; and an antenna assembly, comprising:

an antenna comprising a first antenna portion and a detachable second antenna portion that is connected to the first antenna portion; and an antenna pole, wherein:

the first antenna portion comprises a first radome and a first reflection plate disposed in the first radome, the second antenna portion comprises a second radome and a second reflection plate disposed in the second radome, a plurality of antenna arrays on a working surface of the first reflection plate and a plurality of antenna arrays on a working surface of the second reflection plate are configured to construct different types of antennas based on a quantity of frequency bands and a quantity of transmit and receive channels that are configured for the antenna, wherein some antenna arrays on the first reflection plate and the plurality of antenna arrays on the second reflection plate are configured to jointly construct a first-type antenna, and some other antenna arrays on the first reflection plate are configured to construct a second-type antenna, the antenna further comprises a connecting piece, and the connecting piece is fixedly connected to a back of the first antenna radome and a back of the second radome and is located on an end portion position of the first radome and the second radome, the antenna pole comprises a pole body, and an adjustment arm, a connecting arm, and a support arm that are sequentially fixed on the pole body along an axial direction of the pole body, wherein the adjustment arm is connected to an end portion of the second radome away from the connecting arm, the support arm is connected to an end portion on the first radome away from the connecting arm, to support the first antenna portion and the second antenna portion, the adjustment arm is extended and retracted to adjust tilt angles of the first antenna portion and the second antenna portion at the same time, and the connecting arm is adjustably connected to the connecting piece, so that the first antenna portion and the second antenna portion are always adjusted synchronously, and wherein the pole is detachably fixed on the base station support at different angles.

* * * * *